US005860411A

United States Patent [19]

Thompson et al.

[11] Patent Number: 5,860,411

[45] Date of Patent: Jan. 19, 1999

[54] MODULATING GAS VALVE FURNACE CONTROL METHOD

[75] Inventors: Kevin D. Thompson, Indianapolis; William J. Roy, LaPorte, both of Ind.

[73] Assignee: Carrier Corporation, Syracuse, N.Y.

[21] Appl. No.: 810,231

[22] Filed: Mar. 3, 1997

[51] Int. Cl.[6] ..... F24H 3/00

[52] U.S. Cl. ..... 126/116 A; 126/116 R; 431/20; 137/492.5

[58] Field of Search ..... 126/116 R, 116 A; 431/20; 137/492.5

[56] References Cited

U.S. PATENT DOCUMENTS

| | | | |
|---|---|---|---|
| 3,404,702 | 10/1968 | Telford | 431/90 |
| 4,385,887 | 5/1983 | Yamamoto et al. | 431/90 |
| 4,482,313 | 11/1984 | Cheetham | 126/116 A |
| 4,483,672 | 11/1984 | Wallace et al. | 431/20 |
| 4,626,194 | 12/1986 | Mills | 431/90 |
| 4,708,636 | 11/1987 | Johnson | 431/20 |
| 5,520,533 | 5/1996 | Vrolijk | 431/90 |
| 5,601,071 | 2/1997 | Carr et al. | 126/116 A |
| 5,630,408 | 5/1997 | Versluis | 431/90 |
| 5,642,724 | 7/1997 | Raleigh | 431/90 |

*Primary Examiner*—Carroll B. Dority

[57] ABSTRACT

A furnace control apparatus is described wherein a flow of gas into a burner assembly is directly dependent on an indicia of burner combustion air airflow, such as heat exchanger pressure drop. According to one embodiment of the invention, a first communication fluid line is interposed between a gas valve regulator and a heat exchanger at a first point, and a second communication fluid line is interposed between a gas valve regulator a heat exchanger at a second point. The main valve of the gas valve is responsive to the pressure differential between the first and second points so that a flow of gas into a furnace burner assembly is commensurate with a present flow level of combustion air.

6 Claims, 3 Drawing Sheets

MODULATING GAS VALVE FURNACE CONTROL METHOD

BACKGROUND OF THE INVENTION

1. Field of the Invention:

The invention relates in general to an apparatus for controlling gas flow for combustion in a two-stage furnace. More particularly, the invention relates to an improved valve for directly adjusting the gas flow in a two-stage furnace in response to the pressure drop across the heat exchanger system.

2. Background of the Prior Art:

A gas valve in a typical two-stage furnace includes two discreet position settings. Setting the gas valve to a first position results in a gas flow appropriate for supporting a low stage operating condition while setting the gas valve to a second setting results in a gas flow appropriate for supporting a high stage operating condition. The gas valve in general is switchable between a first and second position by actuation of a solenoid, which is energized via a pressure switch that is responsive to the pressure drop across the furnace heat exchanger system.

It has been the object of recent furnace control methods, however, to eliminate pressure switches which sense pressure drop across the furnace heat exchanger system. For example, application Ser. No. 08/602,436 assigned to a common assignee and incorporated herein by reference, describes a furnace control method which, in a dedicated system embodiment, does not require any pressure switches. In a method of the invention, a variable speed inducer motor in a two-stage furnace is controlled by a lookup table wherein torque required to sustain a stable excess air level (and constant heat exchanger pressure drop) is correlated with current motor speed. If low stage operation is required then the furnace operates in accordance with a low stage operating plot stored in the lookup table with the gas valve set to the first position. If high stage operation is required then the furnace operates in accordance with a high stage operating plot stored in the lookup table. When the high stage condition has been met, the gas valve solenoid is energized to change the gas valve setting from the first position to the second position.

There is a potential problem involved in the use of a two position gas valve in a furnace controlled according to a method wherein a gas valve is made responsive to lookup table. If, due to a selection error or other malfunction a lookup table for controlling a furnace inducer motor is selected that is inappropriate for the present furnace size, the present gas flow level may be inappropriate for the present combustion air level.

SUMMARY OF THE INVENTION

According to its major aspects and broadly stated the present invention is an apparatus for sensing the pressure drop across the furnace heat exchanger system and for adjusting the gas flow accordingly. The apparatus includes a gas valve with an inlet for the introduction of gas into the valve. The gas enters the inlet of the valve and first flows through a manual shutoff valve, the gas continues to flow through a redundant valve, and then flows through the main valve to the outlet. The main valve is typically controlled by a main diaphragm and is biased in the closed direction as a fail-safe. From the outlet, the gas enters a manifold which supplies gas to the burners.

In one embodiment, the gas valve comprises a servo-regulator type valve. In this embodiment, the main valve is adjusted by a regulator loop. A portion of the gas flow into the main valve is diverted into a regulator loop. The regulator loop has two ports, a first port that communicates with a chamber below the main diaphragm and a second port that communicates with a chamber above the main diaphragm. The regulator includes two diaphragms, a top diaphragm and a bottom diaphragm, defining a feedback chamber therebetween and a reference chamber above the top diaphragm. Both of these chambers are subjected to negative pressure, with the more negative pressure in the feedback chamber. The two diaphragms are designed such that the top diaphragm dominates the movement of the bottom diaphragm. The diaphragms are linked in such a way that both diaphragms move in the same direction in response to the pressure differential across the top diaphragm. Preferably, the diaphragms are rigidly linked, however they may also be linked by a biasing means, such as a lever or a spring. Thus, an increase in the negative pressure in the feedback chamber relative to the reference chamber causes both diaphragms to move downward which increases the gas flow through the gas valve. A decrease in the negative pressure in the feedback chamber relative to the reference chamber causes both diaphragms to move upward which decreases the gas flow through the gas valve.

The reference chamber is connected in fluid communication to the burner box while the feedback chamber is connected by in fluid communication to the collector box. These two attachment points permit the measurement of the pressure drop across the heat exchanger system. Other attachment point(s) can be chosen as long as they provide a pressure or pressure differential commensurate with combustion airflow through a furnace. Therefore, when low stage operation is required the variable speed inducer motor in the furnace operates in accordance with a low stage operating plot stored in the lookup table. This operation creates a net pressure difference across the burner box and collector box. When this occurs, the net pressure difference across the top diaphragm sets the gas valve to the proper gas flow for low stage operation. Likewise, when high stage operation is required the variable speed inducer motor in the furnace will increase in speed to operate in accordance with the high stage operating plot stored in the lookup table. When this occurs, the net pressure difference across the top diaphragm increases causing the top diaphragm to move downward, thus increasing the gas flow for high stage operation.

As the pair of diaphragms move downward, continuing with reference to an embodiment comprising a servo-regulator type valve, there is less flow through the second port relative to the flow through the first port. Because the second port communicates with the area above the main diaphragm and the first port communicates with the area below the main diaphragm, a pressure difference will be created across the main diaphragm such that a higher pressure will exist below the main diaphragm relative to the pressure above the main diaphragm. This causes the main valve to move upward toward the open position, thus increasing the gas flow to the burners.

When the net pressure across the top diaphragm decreases, the upper and lower diaphragms move up. This causes more flow through the second port relative to the flow through the first port, which causes a pressure difference across the main diaphragm such that a lower pressure exists below the main diaphragm relative to the pressure above the main diaphragm. This causes the main valve to move downward toward the closed position, thus decreasing the gas flow to the burners.

As a result, this gas flow control methodology assures that even if the net pressure difference across the burner box and collector box is incorrect for low or high stage operation the gas valve will compensate accordingly and supply backup redundancy in the event improper combustion air flow is supplied. In addition, this further allows the elimination of pressure switches and reduces the system cost by replacing a more costly two-stage gas valve with a modulating gas valve in a two-stage furnace.

These and other details, advantages and benefits of the present invention will become apparent from the detailed description of the preferred embodiment hereinbelow.

BRIEF DESCRIPTION OF THE DRAWINGS

The preferred embodiment of the invention will now be described, by way of example only, with reference to the accompanying Figures wherein like members bear like reference numerals and wherein.

DETAILED DESCRIPTION OF THE PREFERRED EMBODIMENT

The instant invention may be applied generally to single or two-stage induced draft gas furnaces. However, for a better understanding of its operation, its use in conjunction with a two-stage condensing furnace is described.

Figure 1:
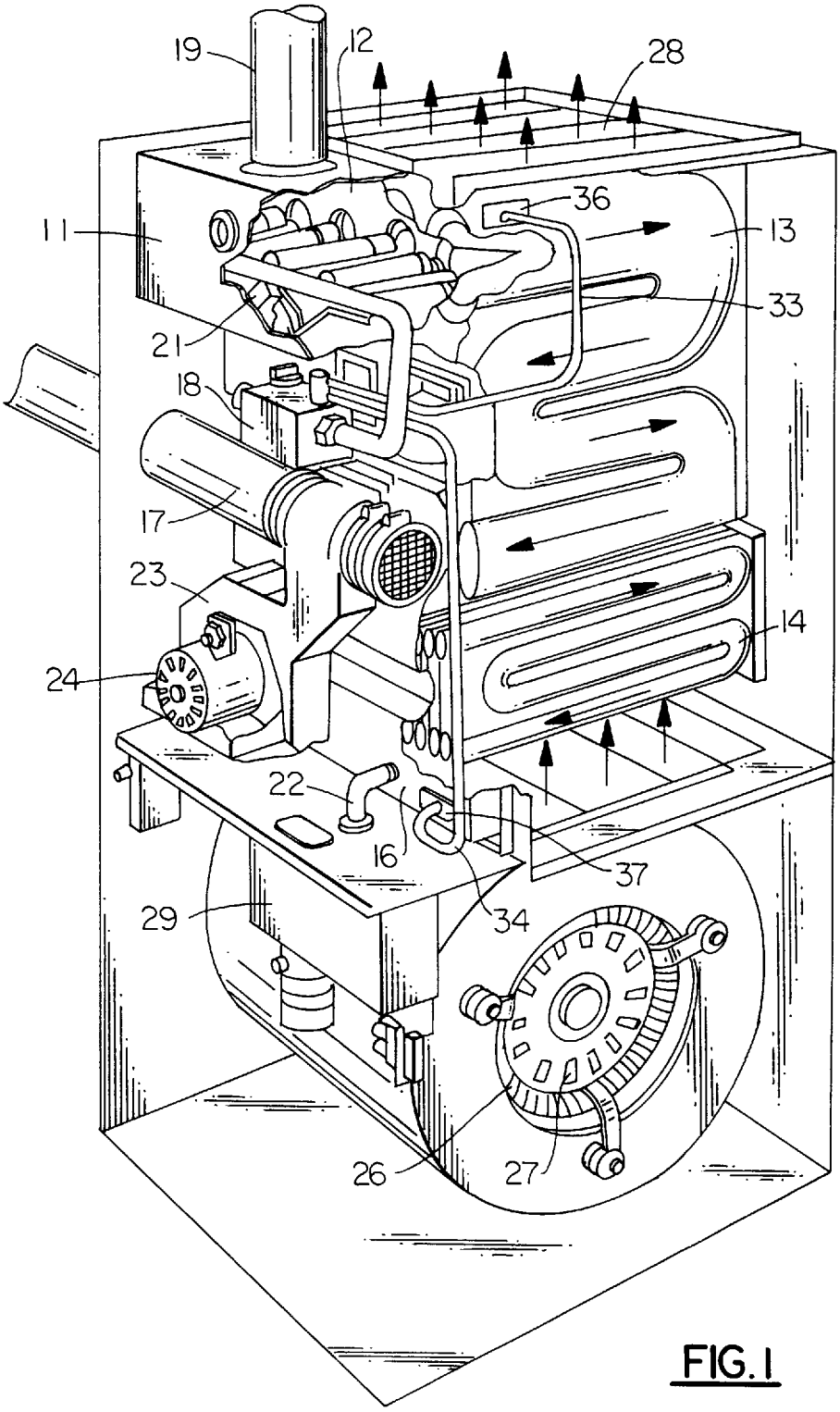
FIG. 1 is a perspective view of a gas furnace having the present invention incorporated therein.

Referring now to FIG. 1, there is shown a furnace of one of the general types with which the present invention can be employed, namely a two-stage condensing furnace. A burner assembly 11 communicates with a burner box 12 to a primary heat exchanger 13. Fluidly connected at the other end of the primary heat exchanger 13 is a condensing heat exchanger 14 whose discharge end is fluidly connected to a collector box 16 and an exhaust vent 17. In operation, gas valve 18 meters the flow of gas to the burner assembly 11 where combustion air from air inlet 19 is mixed and ignited by igniter assembly 21. The hot gas is then passed through the primary heat exchanger 13 and the condensing heat exchanger 14, as shown by the arrows. The relatively cool exhaust gases then pass through the collector box 16 and the exhaust vent 17 to be vented to the atmosphere, while the condensate flows from the collector box 16 through a condensate drain line 22 from where it is suitably drained to a sewer collection or the like. Flow of combustion air into the air inlet 19 through the heat exchangers 13 and 14, and exhaust vent 17, is enhanced by a draft induced blower 23 which is driven by a variable speed ICM inducer motor 24 in response to control signals from the furnace control contained therein.

The household air is drawn into a blower 26 which is driven by a drive motor 27, in response to signals received from either its own internal microprocessor, or the furnace control contained in the furnace control assembly 29, or a combination of both. The discharge air from the blower 26 passes over the condensing heat exchanger 14 and the primary heat exchanger 13, in counterflow relationship with the hot combustion gases, to thereby heat up household air, which then flows from the discharge opening 28 to the duct system within the home.

Figure 2:
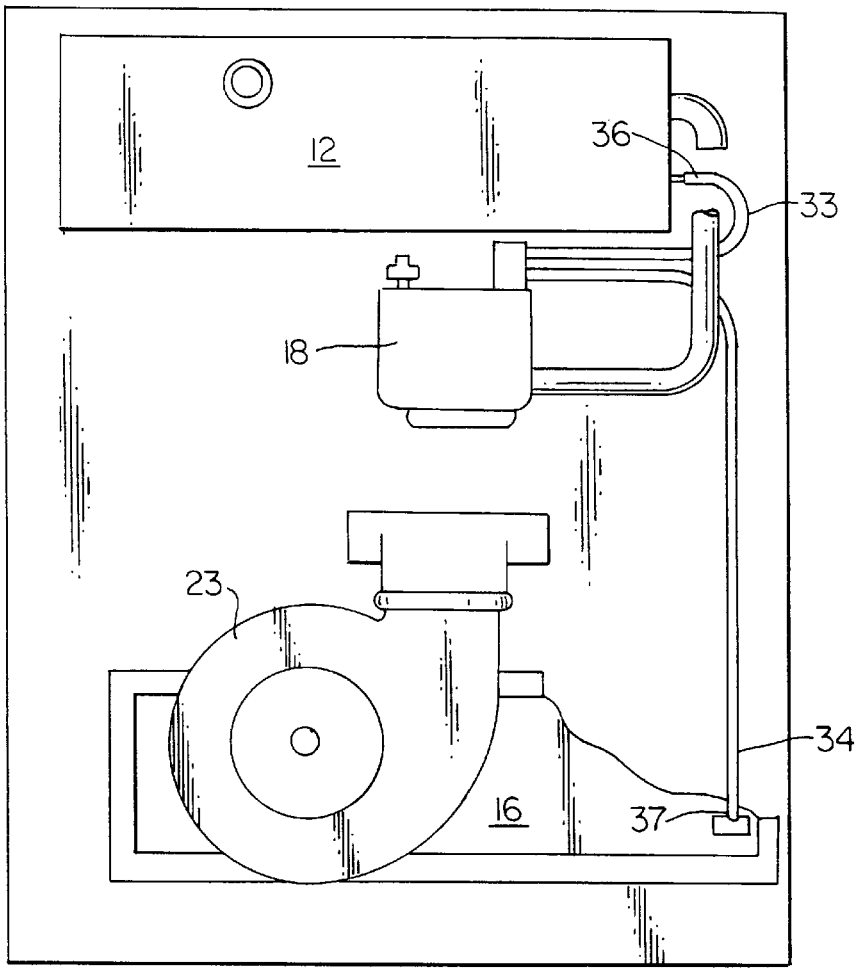
FIG. 2 is a schematic illustration of the installed gas valve thereof as applied to the heat exchanger system.

In one embodiment of this invention, gas valve 18 will be fluidly connected to burner box 12 and collector box 16 so as to permit the measurement of the pressure drop across the heat exchanger system. Gas valve 18 is mechanically connected within the system to sense the heat exchanger pressure drop as shown in FIG. 2.

Specifically, a burner box tube 33 leads from pressure tap 36 and the collector box tube 34 leads from pressure tap 37, and gas valve 18 is fluidly connected therebetween.

Figure 3:
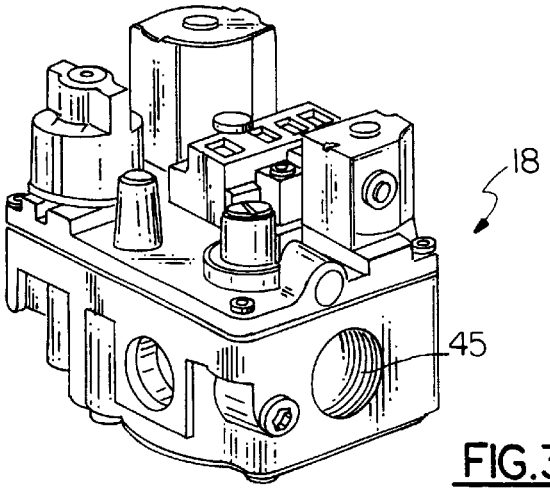
FIG. 3 is a perspective view of a gas valve according to the present invention.
Figure 4:
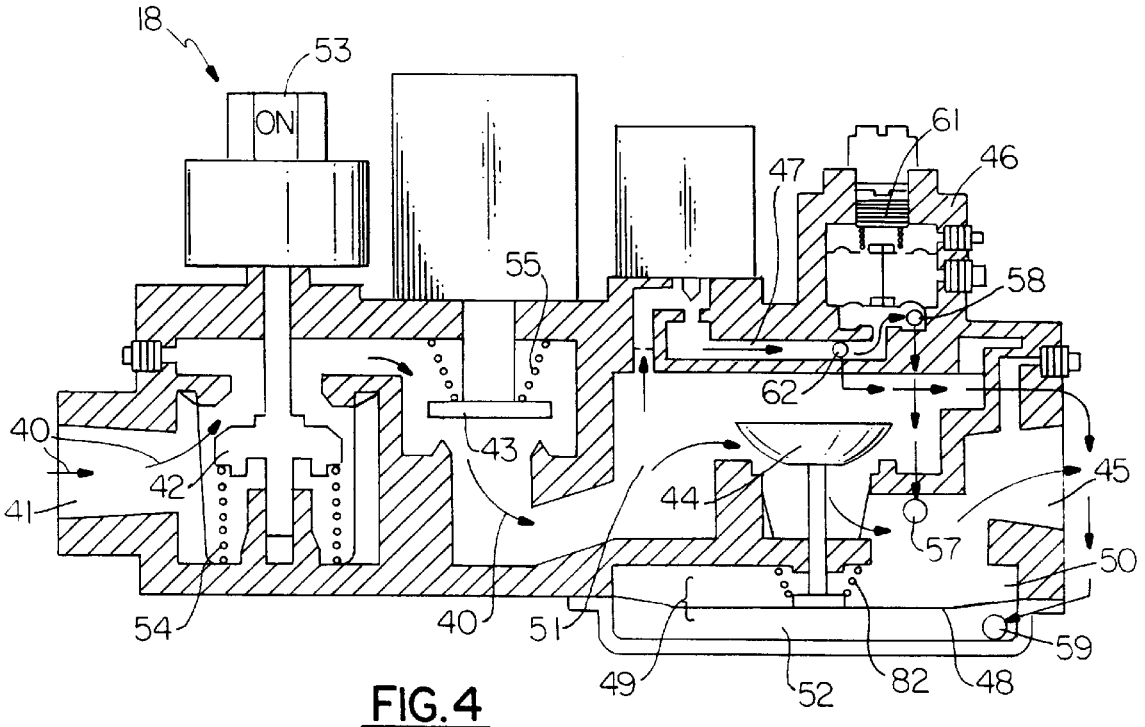
FIG. 4 is a cross sectional view of a gas valve according to the present invention.
Figure 5:
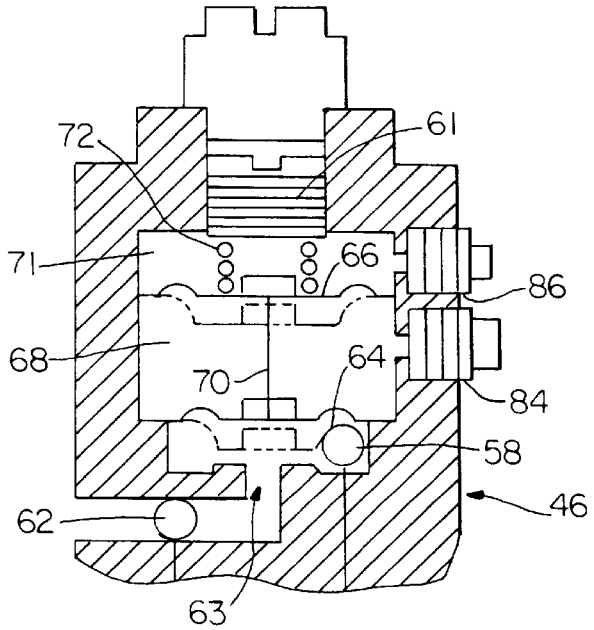
FIG. 5 is an enlarged cross sectional view of the regulator section of a gas valve according to the present invention.

Referring now to FIGS. 3–5, gas valve 18 will be described in detail. Gas valve 18 receives gas 40 at inlet port 41. The gas 40 flows past manual valve 42. The manual valve 42 is controlled by manual gas knob 53 and is biased in the closed position by a spring 54. The gas 40 then flows to a redundant valve 43 which is also biased in the closed position by a spring 55. The gas 40 then flows to a main valve 44 which is biased in the closed position by a spring 82. The main valve 44 is controlled by diaphragm 48. The diaphragm 48 has a chamber 52 below diaphragm 48 and a chamber 50 above the diaphragm 48. Changes in gas pressure in chamber 50 and/or 52 control the movement of main valve 44.

The gas pressure in chambers 50 and 52 is determined by a regulator 46. The regulator 46 receives gas 40 diverted from the main valve 44 into a regulator loop 47. The regulator loop 47 includes a first port 62 in communication with a port 59 below diaphragm 48. The regulator loop 47 also includes a second port 58 in communication with a port 57 above diaphragm 48. The gas flow through ports 58 and 62 is determined by the position of a lower diaphragm 64 in regulator 46 and an upper diaphragm 66 in regulator 46. Preferably, the diaphragms 64 and 66 are rigidly connected. Preferably, a spring 72 is disposed between the upper diaphragm 66 and adjustment screw 61. This spring is for outlet pressure adjustment. A feedback chamber 68 is created between diaphragms 64 and 66 and a reference chamber 74 is created above diaphragm 66. With diaphragms 64 and 66 rigidly connected (70) they move in the same direction. Since diaphragm 66 is larger, it will determine the direction of movement for any net changes in the pressure differential across the top diaphragm 66.

The feedback chamber 68 receives pressure from the feedback pressure tap 84 and the reference chamber 74 receives pressure from the reference pressure tap 86. The feedback pressure tap 84 is fluidly connected to the collector box 16 and the reference pressure tap 86 is fluidly connected to burner box 12.

When the ICM inducer motor 24 is in operation the system develops a negative pressure in burner box 12 and collector box 16 with the more negative pressure in collector box 16. Therefore, pressure changes will be transmitted to the feedback chamber 68 and the reference chamber 74.

If the negative pressure in the feedback chamber 68 increases relative to the negative pressure in reference chamber 74, diaphragms 64 and 66 fall. As this occurs, the opening 63 becomes smaller and less gas flows to the second port 58. Decreased gas flow to the second port 58 causes an increase in gas pressure in chamber 52 below diaphragm 48. This causes diaphragm 48 to move upward and as a result causes main valve 44 to move toward the fully open position.

If the negative pressure in the feedback chamber 68 decreases relative to the negative pressure in reference chamber 74, diaphragms 64 and 66 rise. As this occurs, the opening 63 becomes larger and more gas flows to the second port 58. Increased gas flow to the second port 58 causes a decrease in gas pressure in chamber 52 below diaphragm 48. This causes diaphragm 48 to move downward and as a result causes main valve 44 to move toward the fully closed position. Therefore, an increase in the net heat exchanger pressure drop results in main valve 44 opening to allow an increased flow of gas into burner assembly 11 and a decrease in the net heat exchanger pressure drop results in main valve 44 closing to allow a decreased flow of gas into burner assembly 11.

In the subject two-stage furnace, inducer motor 24 is modulated to generate a constant combustion air flow which in essence causes a constant heat exchanger pressure drop at a first level for low stage operation and a second level for high stage operation. It is an object of the invention to configure gas valve 14 so that gas valve 14 produces a gas flow at a first level when the furnace is in low stage operation and at a second level when the furnace is at high stage operation.

Regulator spring 72 is designed and adjusted so that gas valve 18 produces a gas flow at an appropriate level commensurate with low and high stage operation. Regulator spring 72 adjusts regulator diaphragms 64 and 66 so that the gas flow is at a first predetermined level when the pressure differential between feedback and reference chambers 68 and 74 is at a first level corresponding to low stage operation as well as a second predetermined level when the chamber pressure differential is at a level corresponding to high stage operation assuming regulator spring 72 is properly designed.

Meanwhile diaphragm 48 adjusts the degree of opening and closing of main valve 44 in response to pressure differentials between feedback and reference chambers 68 and 74, and therefore adjusts the flow of gas 40 into burner assembly 11. It is seen that if a problem in furnace operation results in the pressure differential between the feedback and reference chambers 68 and 74 being at a level other than one corresponding to low or high stage operation, that gas valve 18 will produce a gas flow appropriate for the present pressure differential between the feedback and reference chambers 68 and 74.

The servo-regulator type gas valve described thus far and which is preferred for cost reasons and because of wind-effect compensation advantages as described in commonly assigned copending application Ser. No. 08/810,230 entitled "A Differential Pressure Modulated Gas Valve for Single Stage Combustion Control", filed concurrently herewith and incorporated by reference herein, can have many variations. For example, diaphragm 66 can be replaced with a stepper motor responsive to pressure sensor signal which controls movement of diaphragm 64 in accordance with sensed heat exchanger pressure drop. Another mechanical apparatus other than regulator 46 can be made to control relative air flow through ports 57 and 59 to control movement of diaphragm 48 in accordance with sensed combustion airflow, or else diaphragm 48 can be deleted entirely, and the opening and closing of main valve 44 can be controlled directly to plurality of intermediate positions by a mechanical apparatus responsive to heat exchanger pressure differential or another indicator of combustion airflow, such as a stepper motor responsive to a pressure sensor pressure signal. In addition, a throttling valve could be disposed downstream from outlet 45 so that a flow of gas in burner box 12 is commensurate with combustion air flow, typically indicated by heat exchanger pressure drop. A major feature of a gas valve that is designed in accordance with the invention is that the valve provides a gas flow that is commensurate with the current combustion air level, and does not merely provide a gas flow at one of two possible discreet levels.

The arrangement described is in contrast to two-stage furnace gas valves of the prior art which are switchable between two discreet (low stage, high stage) positions and which are responsive to pressure switches sensing heat exchanger pressure drop. In prior art two-stage furnace control methods wherein the changing of operation stages is responsive to pressure switches, a two-stage gas valve does not present a danger to furnace operation, because the gas flow from the gas valve is assured of being substantially commensurate with the detected combustion air flow sensed via the heat exchanger pressure drop.

If the furnace is controlled according to a control method wherein staged operation is responsive to control method other than a pressure switch making, there is a risk that the present gas flow level will be inappropriate for the present combustion air flow level. The possibility that a two-position gas valve will discharge a level of gas flow that is inappropriate for the present combustion air flow exists, for example, if a furnace ICM inducer motor is, due to a selection error or other malfunction, controlled according to a lookup table that is inappropriate for the present furnace size. The potential for such a problem exists in the control method described in copending application Ser. No. 08/602,436. While its use is particularly advantageous where a furnace does not have pressure switches determining operating stages, it will be clear to person skilled in the art that the gas valve apparatus described herein can be advantageously incorporated into any furnace system, including those having pressure switches.

Because gas flow in the described invention is directly dependent on sensed heat exchanger pressure drop, the present invention assures gas flow is commensurate with combustion air flow. Thereby, implemented as described, the present invention provides for safe control of a furnace without the need for costly pressure switches, pressure transducers and associated circuitry, or two-stage gas valves.

While this invention has been described in detail with reference to a preferred embodiment, it should be appreciated that the present invention is not limited to that precise embodiment. Rather, in view of the present disclosure which describes the best mode for practicing the invention, many modifications and variations would present themselves to those skilled in the art without departing from the scope and spirit of this invention, as defined in the following claims.

What is claimed is:

1. A gas valve and control assembly for controlling a flow of gas to a burner assembly of a furnace, comprising:

a main valve for controlling a flow of gas to said burner assembly;

a heat exchanger in fluid communication with said burner assembly;

sensing means for sensing a pressure drop across said heat exchanger; and moving means responsive to said sensing means for moving said main valve to a position dependent on said pressure drop as sensed by said sensing means.

2. The gas valve of claim 1, wherein said gas valve is a servo-regulator type gas valve having a regulator, and wherein said sensing means is provided by said regulator.

3. The gas valve of claim 1, wherein said gas valve is a servo-regulator type gas valve having a regulator, and wherein said regulator is in fluid communication with said heat exchanger in at least two distinct points so that said sensing means senses a pressure drop across the heat exchanger.

4. A furnace assembly comprising:

a burner assembly;

a heat exchanger in fluid communication with said burner assembly; and a gas valve for controlling a flow of gas to said burner assembly, said gas valve comprising:

a main valve for controlling a flow of gas to said burner assembly;

sensing means for sensing a pressure drop across said heat exchanger; and moving means responsive to said sensing means for moving said main valve to a position dependent on said pressure drop as sensed by said sensing means.

5. The furnace assembly of claim 1, wherein said gas valve is a servo-regulator type gas valve having a regulator, and wherein said sensing means is provided by said regulator.

6. The furnace assembly of claim 5, wherein said gas valve is a servo-regulator type gas valve having a regulator, and wherein said regulator is in fluid communication with said heat exchanger in at least two distinct points so that said sensing means senses a pressure drop across said heat exchanger.

* * * * *